US011660635B2

(12) United States Patent
Fujimura et al.

(10) Patent No.: US 11,660,635 B2
(45) Date of Patent: May 30, 2023

(54) METHOD OF MANUFACTURING TUBULAR MEMBER FOR EXHAUST GAS TREATMENT DEVICE, AND COATING FILM FORMING DEVICE

(71) Applicant: NGK INSULATORS, LTD., Nagoya (JP)

(72) Inventors: Ryo Fujimura, Komaki (JP); Kodai Kato, Iwakura (JP); Akifumi Nishio, Ena (JP)

(73) Assignee: NGK INSULATORS, LTD., Nagoya (JP)

( * ) Notice: Subject to any disclaimer, the term of this patent is extended or adjusted under 35 U.S.C. 154(b) by 0 days.

(21) Appl. No.: 17/643,601

(22) Filed: Dec. 10, 2021

(65) Prior Publication Data

US 2022/0288631 A1 Sep. 15, 2022

(30) Foreign Application Priority Data

Mar. 15, 2021 (JP) ..... JP2021-041347

(51) Int. Cl.

| | |
|---|---|
| ***B05D 3/02*** | (2006.01) |
| ***F01N 13/14*** | (2010.01) |
| ***B05D 1/02*** | (2006.01) |
| ***B05D 1/00*** | (2006.01) |

(52) U.S. Cl.

CPC ..... *B05D 3/0254* (2013.01); *B05D 1/005* (2013.01); *B05D 1/02* (2013.01); *F01N 13/141* (2013.01); *F01N 13/148* (2013.01)

(58) Field of Classification Search

CPC . B05D 1/02; B05D 7/22; B05D 7/222; B05D 7/225

See application file for complete search history.

(56) References Cited

U.S. PATENT DOCUMENTS

| | | | | |
|---|---|---|---|---|
| 7,014,884 | B2 * | 3/2006 | Suzuki | B05C 11/1042 118/694 |
| 8,784,741 | B2 | 7/2014 | Yoshioka et al. | |
| 2013/0025267 | A1 | 1/2013 | Yoshioka et al. | |

FOREIGN PATENT DOCUMENTS

| | | | |
|---|---|---|---|
| JP | 2012-154316 | A | 8/2012 |
| JP | 201254316 | * | 8/2012 |
| JP | 5408341 | B2 | 2/2014 |

* cited by examiner

*Primary Examiner* — Nathan T Leong

(74) *Attorney, Agent, or Firm* — Burr Patent Law, PLLC

(57) ABSTRACT

A method of manufacturing a tubular member for an exhaust gas treatment device according to at least one embodiment of the present invention, the tubular member including a tubular main body made of a metal and an insulating layer formed on at least an inner peripheral surface of the tubular main body, the insulating layer containing glass, includes steps of: forming a coating film by spraying a coating liquid for insulating layer formation onto the inner peripheral surface of the tubular main body; and firing the coating film to obtain the insulating layer. The spraying is performed while the tubular main body is rotated with a length direction thereof being a rotation axis.

11 Claims, 4 Drawing Sheets

METHOD OF MANUFACTURING TUBULAR MEMBER FOR EXHAUST GAS TREATMENT DEVICE, AND COATING FILM FORMING DEVICE

CROSS-REFERENCE TO RELATED APPLICATION

The present application claims priority from Japanese Application JP 2021-41347 filed on Mar. 15, 2021, the content of which is hereby incorporated by reference into this application.

BACKGROUND OF THE INVENTION

1. Field of the Invention

One or more embodiments of the present invention relate to a method of manufacturing a tubular member for an exhaust gas treatment device, and to a coating film forming device.

2. Description of the Related Art

A catalyst support obtained by causing a support to support a catalyst is used for treatment of a harmful substance in an exhaust gas discharged from a vehicle engine. In this case, there is a problem in that, when a temperature of the catalyst is low at a start of the engine, the temperature of the catalyst is not increased to a predetermined temperature, resulting in a failure to sufficiently purify the exhaust gas. In order to solve such problem, progress is being made in development of an exhaust gas treatment device using an electric heating catalyst (EHC), in which a support having conductivity is energized to cause the support to generate heat, to thereby increase the temperature of the catalyst supported on the support to its active temperature before the start of the engine or at the start of the engine.

In the exhaust gas treatment device, the EHC is typically housed in a tubular member made of a metal (sometimes referred to as "can"). The EHC can be excellent in purification efficiency for the exhaust gas at the start of the vehicle, but electricity leaks from the EHC to surrounding exhaust piping, resulting in a failure, such as a reduction in purification efficiency, in some cases. In order to solve such problem, in each of Japanese Patent No. 5408341 and Japanese Patent Application Laid-open No. 2012-154316, there is a disclosure that the leakage of electricity is prevented by forming an insulating layer on an inner peripheral surface of the tubular member.

SUMMARY OF THE INVENTION

The insulating layer may be typically obtained by applying a coating liquid for insulating layer formation to form a coating film and firing the coating film. However, the coating liquid for insulating layer formation drips when applied, and hence thickness unevenness in the insulating layer to be obtained occurs to make the quality of the insulating layer poor in some cases.

One or more embodiments of the present invention have been made in view of the problems described above, a primary object of thereof is to provide a tubular member including an insulating layer excellent in quality with suppressed thickness unevenness.

A method of manufacturing a tubular member for an exhaust gas treatment device according to at least one embodiment of the present invention, the tubular member including a tubular main body made of a metal and an insulating layer formed on at least an inner peripheral surface of the tubular main body, the insulating layer containing glass, includes steps of: forming a coating film by spraying a coating liquid for insulating layer formation onto the inner peripheral surface of the tubular main body; and firing the coating film to obtain the insulating layer, wherein the spraying is performed while the tubular main body is rotated with a length direction thereof being a rotation axis.

A method of manufacturing a tubular member for an exhaust gas treatment device according to at least one embodiment of the present invention, the tubular member including a tubular main body made of a metal and an insulating layer formed on at least an inner peripheral surface of the tubular main body, the insulating layer containing glass, includes steps of: forming a coating film by spraying a coating liquid for insulating layer formation onto the inner peripheral surface of the tubular main body; and firing the coating film to obtain the insulating layer, wherein the spraying is performed for the tubular main body subjected to heating.

In at least one embodiment, the heating of the tubular main body is performed at a timing selected from: during the spraying; before the spraying; after the spraying; or a combination thereof.

In at least one embodiment, the coating liquid for insulating layer formation has a viscosity of 1 dPa·s or more.

In at least one embodiment, the forming a coating film is performed using a nozzle configured to jet the coating liquid for insulating layer formation, and the spraying a coating liquid for insulating layer formation is performed by moving the nozzle in the tubular main body.

In at least one embodiment, the spraying is performed by repeating, a plurality of times, movement of the nozzle from a first end portion of the tubular main body to a second end portion thereof, and movement of the nozzle from the second end portion of the tubular main body to the first end portion thereof.

In at least one embodiment, the insulating layer has a thickness of 30 μm or more.

A coating film forming device according to at least one embodiment of the present invention includes: a rotating unit configured to fix a tubular main body made of a metal, and to rotate the tubular main body with a length direction thereof being a rotation axis; a spraying unit configured to spray a coating liquid for insulating layer formation onto at least an inner peripheral surface of the tubular main body; and a heating unit configured to heat the tubular main body.

In at least one embodiment, the spraying unit is movable in the length direction of the tubular main body.

DESCRIPTION OF THE EMBODIMENTS

Embodiments of the present invention are described below with reference to the drawings. However, the present invention is not limited to these embodiments.

Figure 1:
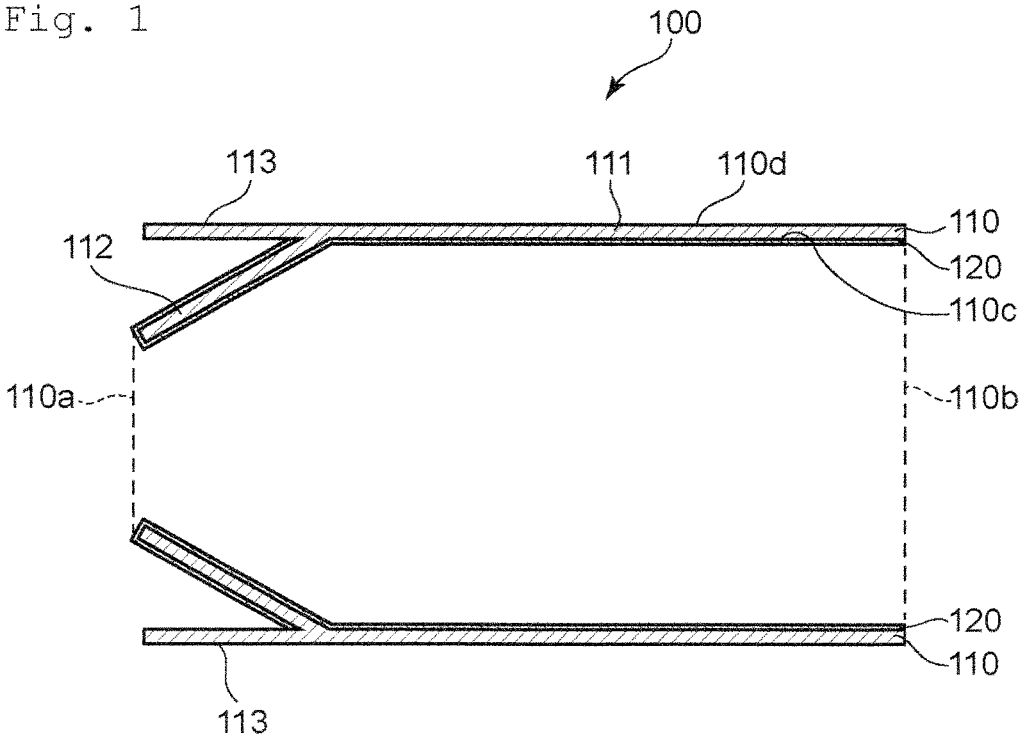
FIG. 1 is a sectional view for illustrating a tubular member to be used in an exhaust gas treatment device according to at least one embodiment of the present invention.

FIG. 1 is a sectional view for illustrating the schematic configuration of a tubular member to be used in an exhaust gas treatment device according to at least one embodiment of the present invention. A tubular member 100 includes a tubular main body 110 made of a metal and an insulating layer 120 formed on the tubular main body 110.

The tubular main body 110 has a straight portion 111 of a cylindrical shape and a reduced diameter portion 112 whose inner diameter is continuously reduced toward a first end surface 110*a* side (left side or upstream side in FIG. 1). In addition to such reduced diameter portion, for example, another member (not shown) may be combined to form a complicated structure. Specifically, an extending portion 113 extending on the first end surface 110*a* side is formed on the end portion of the straight portion 111 on the first end surface 110*a* side, and the reduced diameter portion 112 is surrounded by the extending portion 113. Another member (not shown) within which the reduced diameter portion 112 can be housed, and the extending portion 113 may be fitted together to form a complicated structure.

As a material for forming the tubular main body 110, there are given, for example, stainless steel, a titanium alloy, a copper alloy, an aluminum alloy, and brass. Of those, stainless steel is preferred because of high endurance reliability and low cost.

The thickness of the tubular main body 110 may be, for example, from 0.1 mm to 10 mm, from 0.3 mm to 5 mm, or from 0.5 mm to 3 mm from the viewpoint of endurance reliability. The length of the tubular main body 110 may be appropriately set in accordance with the sizes, number, and arrangement of objects to be housed, such as a catalyst support to be described later, purposes, and the like. The length of the tubular main body may be, for example, from 30 mm to 600 mm, from 40 mm to 500 mm, or from 50 mm to 400 mm. The length of the tubular main body is preferably larger than the length of an electric heating catalyst support to be described later. In this case, the electric heating catalyst support may be arranged so that the electric heating catalyst support is not exposed from the tubular main body.

The surface (e.g., inner peripheral surface) of the tubular main body 110 may be subjected to surface treatment (not shown). A typical example of the surface treatment is treatment such as blasting. Through the roughening treatment, adhesiveness between the tubular main body 110 and the insulating layer 120 can be improved.

The insulating layer 120 may impart an electrical insulating property between the tubular member 100 and the objects to be housed, such as a catalyst support to be described later. Herein, the electrical insulating property typically satisfies JIS standard D5305-3 from the viewpoint of suppressing the leakage of electricity to surrounding exhaust piping, and an insulation resistance value per unit voltage is, for example, 100 Ω/V or more. The insulating layer 120 preferably has moisture impermeability and moisture non-absorbability. Specifically, the insulating layer 120 is preferably configured to be so dense as to prevent the permeation and absorption of water. Regarding denseness, the insulating layer has a porosity of, for example, 10% or less, and for example, 8% or less.

The insulating layer 120 contains glass. The composition of the glass is not particularly limited, and glasses having various compositions may be used. Specific examples of the glass include silicate glass, barium glass, boron glass, strontium glass, aluminosilicate glass, soda zinc glass, and soda barium glass. Those glasses may be used alone or in combination thereof.

The glass is preferably crystalline substance-containing glass. When the glass contains a crystalline substance, an insulating layer that is less liable to soften and deform even under high temperature (e.g., 750° C. or more) can be obtained. In addition, an insulating layer excellent in adhesiveness with the tubular main body can be obtained. Specifically, a difference in thermal expansion coefficient between the insulating layer and the tubular main body (metal) can be reduced, and hence a thermal stress occurring at the time of heating can be reduced. The presence or absence of the crystalline substance (crystal) may be determined by an X-ray diffraction method.

In at least one embodiment of the present invention, the glass contains silicon and boron. The glass may contain silicon in the form of $SiO_2$, and the glass may contain boron in the form of $B_2O_3$. Specifically, the glass is $SiO_2$—$B_2O_3$-based glass (borosilicate glass). The content of silicon in the glass is preferably from 5 mol % to 50 mol %, more preferably from 7 mol % to 45 mol %, still more preferably from 10 mol % to 40 mol %. The content of boron in the glass is preferably from 5 mol % to 60 mol %, more preferably from 7 mol % to 57 mol %, still more preferably from 8 mol % to 55 mol %.

The glass may contain, in addition to silicon and boron, another component (metal element), such as magnesium, barium, lanthanum, zinc, or calcium. For example, the glass may further contain magnesium. The glass may contain magnesium in the form of MgO. In this case, the content of magnesium in the glass is preferably 10 mol % or more, more preferably from 15 mol % to 55 mol %. In addition, for example, the glass may further contain barium. The glass may contain barium in the form of BaO. In this case, the content of barium in the glass is preferably from 3 mol % to 30 mol %, more preferably from 5 mol % to 25 mol %, still more preferably from 6 mol % to 20 mol %.

Herein, the "content of an element in the glass" is the molar ratio of atoms of the element in question with respect to 100 mol % of the amount of all atoms in the glass except oxygen atoms. The amount of atoms of each element in the glass is measured by, for example, inductively coupled plasma (ICP) emission spectrometry.

The thickness of the insulating layer 120 is, for example, preferably 30 μm or more, more preferably 50 μm or more, still more preferably 100 μm or more, particularly preferably 150 μm or more from the viewpoint of obtaining an excellent insulating property. Meanwhile, the thickness of the insulating layer 120 is, for example, 800 μm or less, preferably 600 μm or less.

In the illustrated example, the insulating layer 120 is formed over the entirety of an inner peripheral surface 110*c* of the tubular main body 110. In addition, in the end portion on the first end surface 110*a* side, the insulating layer 120 is formed to range from the inner peripheral surface 110*c* to an outer peripheral surface 110*d*. The region in which the insulating layer is formed may be appropriately set in accordance with the sizes, number, and arrangement of objects to be housed, such as an electric heating catalyst support to be described later, purposes, and the like. For example, unlike the illustrated example, in the inner peripheral surface 110*c* of the tubular main body 110, a nonformation region in which the insulating layer 120 is not formed may be arranged in an end portion on a second end surface 110*b* side.

The insulating layer 120 may be typically obtained by applying a coating liquid for insulating layer formation to the tubular main body 110 to form a coating film and firing the coating film.

The coating film is formed by spraying the coating liquid for insulating layer formation. According to the spraying, for example, a uniform coating film can be formed at a desired site on the tubular main body irrespective of the shape of the tubular main body.

The coating liquid for insulating layer formation is typically a slurry (dispersion) containing a glass source and a solvent. The coating liquid for insulating layer formation may contain raw materials or glass frit as the glass source. In at least one embodiment of the present invention, the coating liquid for insulating layer formation is obtained by producing glass frit from raw materials and mixing the resultant glass frit with the solvent. Herein, the "solvent" refers to a liquid medium contained in the coating liquid for insulating layer formation, and is a concept encompassing solvent and dispersion medium.

Specific examples of the raw material include silica sand (silicon source), dolomite (magnesium and calcium source), alumina (aluminum source), boric acid, barium oxide, lanthanum oxide, zinc oxide (zinc flower), and strontium oxide. The raw material is not limited to an oxide, and may also be, for example, a carbonate or a hydroxide. The glass frit is typically obtained by pulverizing glass produced by synthesis from raw materials (e.g., pulverizing the glass in two stages of coarse pulverization and fine pulverization). The synthesis is typically performed by melting under high temperature (e.g., 1,200° C. or more) for a long period of time.

The solvent may be water or an organic solvent. The solvent is preferably water or a water-soluble organic solvent, such as an alcohol, and is more preferably water. The blending amount of the solvent is, for example, preferably from 50 parts by mass to 300 parts by mass, more preferably from 80 parts by mass to 200 parts by mass with respect to 100 parts by mass of the glass source.

The coating liquid for insulating layer formation (slurry) may contain a slurry aid. Examples of the slurry aid include a resin, a plasticizer, a dispersant, a thickener, and various other additives. The kinds, number, combination, blending amounts, and the like of the slurry aids may be appropriately set in accordance with purposes.

The viscosity of the coating liquid for insulating layer formation (at the time of its application) is preferably 1 dPa·s or more, more preferably 2 dPa·s or more, still more preferably 5 dPa·s or more. When the viscosity is set as just described, the shear rate of the coating liquid for insulating layer formation sprayed onto the surface of the tubular main body can be reduced, and hence dripping of the coating liquid for insulating layer formation until its drying can be suppressed. Meanwhile, the viscosity of the coating liquid for insulating layer formation (at the time of its application) is, for example, 50 dPa·s or less. The viscosity of the coating liquid for insulating layer formation is controlled by, for example, adjusting the blending amount of the solvent.

For example, the thickness of the coating film of the coating liquid for insulating layer formation only needs to be appropriately adjusted in accordance with the desired thickness of the insulating layer (after firing). Specifically, the thickness of the coating film may be set to be from about 2 to about 5 times as large as the thickness of the insulating layer.

Figure 2:
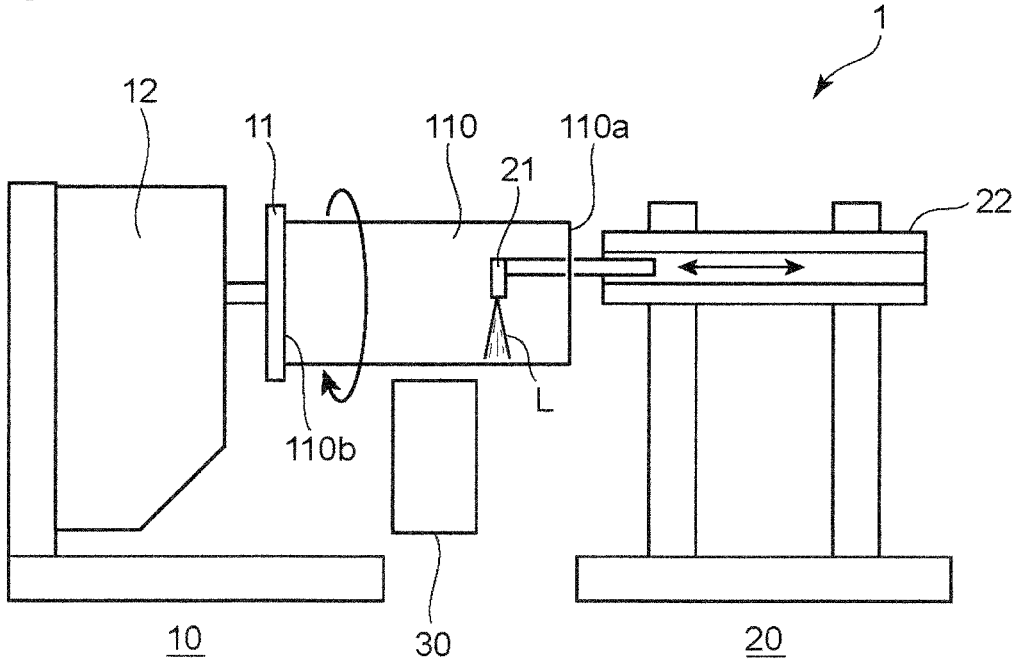
FIG. 2 is a schematic view for illustrating the entire configuration of a coating film forming device according to at least one embodiment of the present invention.

FIG. 2 is a schematic view for illustrating the entire configuration of a coating film forming device according to at least one embodiment of the present invention. Specifically, FIG. 2 is a side view of a coating film forming device 1. The coating film forming device 1 includes: a rotating unit 10 for fixing and rotating the tubular main body 110; a spraying unit 20 for spraying a coating liquid for insulating layer formation onto the tubular main body 110; and a heating unit 30 for heating the tubular main body 110.

The rotating unit 10 includes: a table 11 to whose surface the tubular main body 110 is to be fixed; and a driving portion 12 for rotating the table 11. In order that the tubular main body 110 may be rotated with its length direction being a rotation axis, the second end surface 110*b* is fixed to the table 11. The rotation axis is preferably the central axis of the tubular main body 110.

The spraying unit 20 includes: a nozzle 21 capable of jetting a coating liquid L for insulating layer formation supplied from a device (not shown) for supplying a coating liquid for insulating layer formation; and a uniaxial robot (monoaxial robot) 22 for allowing the nozzle 21 to move in the length direction of the tubular main body 110. In FIG. 2, the nozzle 21 and the coating liquid L for insulating layer formation, which are invisible from the outside, are illustrated in solid lines for the sake of convenience.

The heating unit 30 heats the tubular main body 110 by blowing hot air against the outer peripheral surface of the tubular main body 110.

The spraying of the coating liquid L for insulating layer formation is, for example, as illustrated in FIG. 2, performed while the tubular main body 110 is rotated under a state in which the nozzle 21 is arranged inside the tubular main body 110. When the tubular main body 110 is rotated during the spraying of the coating liquid L for insulating layer formation, a centrifugal force is applied to the coating liquid L for insulating layer formation sprayed onto the inner peripheral surface of the tubular main body 110, and hence dripping (e.g., dripping in a circumferential direction) can be suppressed to suppress thickness unevenness.

Specifically, the nozzle 21 is moved in a direction from the end portion (first end portion) of the tubular main body 110 on the first end surface 110*a* side to the end portion (second end portion) thereof on the second end surface 110*b* side to spray the coating liquid L for insulating layer formation onto the inner peripheral surface of the tubular main body 110 (first spraying). In this case, the position of the nozzle 21 is adjusted so as to prevent the nozzle 21 from being brought into contact with the tubular main body 110. Next, the nozzle 21 is moved in a direction from the end portion (second end portion) of the tubular main body 110 on the second end surface 110*b* side to the end portion (first end portion) thereof on the first end surface 110*a* side to spray the coating liquid L for insulating layer formation onto the inner peripheral surface of the tubular main body 110 (second spraying). Thus, the first spraying and the second spraying are performed by moving the nozzle 21 back and forth in the length direction of the tubular main body 110. The back-and-forth movement may be repeated a plurality of times. Through adjustment of the spraying amount of the coating liquid L for insulating layer formation, the moving speed of the nozzle 21, and the number of repetitions of the movement, a coating film having a desired thickness can be formed while dripping of the coating liquid L for insulating layer formation sprayed onto the surface of the tubular main body 110 is effectively suppressed.

The heating of the tubular main body 110 by the heating unit 30 may be performed at any appropriate timing. Specifically, the heating may be performed: before the spraying of the coating liquid for insulating layer formation; during the spraying; after the spraying; or a combination thereof. In addition, the heating may be performed continuously, or may be performed intermittently. The heating temperature of the tubular main body is, for example, from 50° C. to 120° C. When the spraying of the coating liquid L for insulating layer formation is accompanied by heating the tubular main body 110, drying of the coating liquid L for insulating layer formation sprayed onto the surface of the tubular main body 110 is promoted, and hence dripping thereof can be suppressed to suppress thickness unevenness. In addition, recoating intervals based on the back-and-forth movement of the nozzle 21 can be reduced, and hence a coating film having a desired thickness can be formed within a short period of time.

As a modified example (not shown), the nozzle 21 may be arranged on the outside of the tubular main body 110 to form a coating film on the outer peripheral surface of the tubular main body 110. The movement of the nozzle 21, and heating may be performed in the same manner as in the formation of the coating film on the inner peripheral surface described above.

As described above, the obtained coating film is fired. A firing temperature is preferably 1,100° C. or less, more preferably from 600° C. to 1,100° C., still more preferably from 700° C. to 1,050° C. A firing time is, for example, from 5 minutes to 30 minutes, or may be from 8 minutes to 15 minutes.

Figure 3:
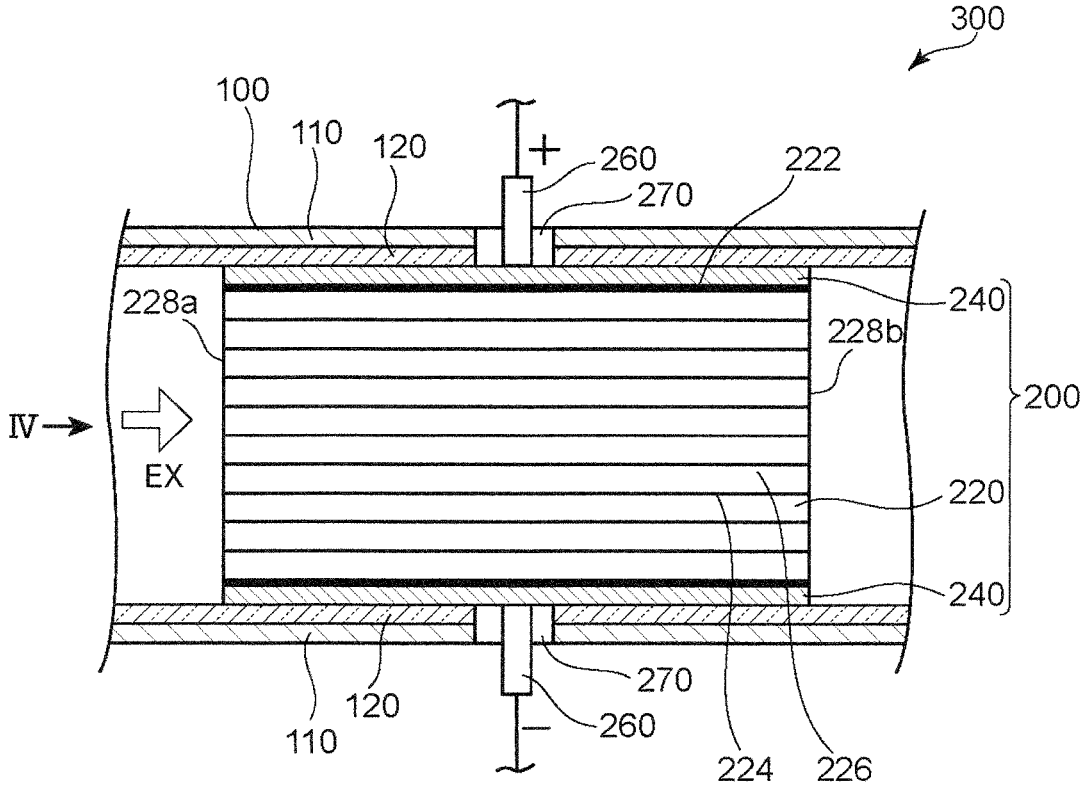
FIG. 3 is a schematic sectional view for illustrating the schematic configuration of the exhaust gas treatment device according to at least one embodiment of the present invention.
Figure 4:
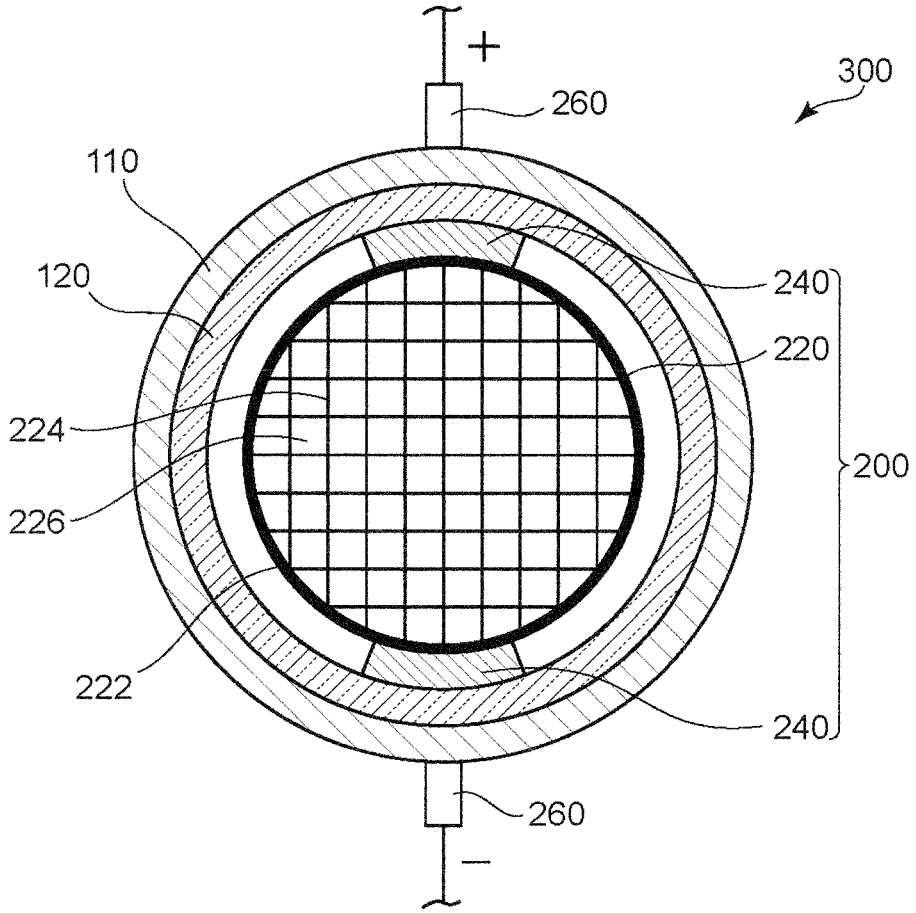
FIG. 4 is a view of the exhaust gas treatment device of FIG. 3 seen from the direction of the arrow IV.

FIG. 3 is a schematic sectional view for illustrating the schematic configuration of the exhaust gas treatment device according to at least one embodiment of the present invention, and FIG. 4 is a view of an exhaust gas treatment device 300 of FIG. 3 seen from the direction of the arrow IV. The exhaust gas treatment device 300 is installed in a flow path through which an exhaust gas from an engine is to be flowed. In FIG. 3, as indicated by the arrow EX, the exhaust gas flows from left to right in the exhaust gas treatment device 300.

The exhaust gas treatment device 300 includes the tubular member 100 and an electric heating catalyst support (hereinafter sometimes referred to simply as "catalyst support") 200 housed in the tubular member 100 and capable of heating the exhaust gas.

The catalyst support 200 has a shape corresponding to the shape of the tubular member 100, and is coaxially housed in the tubular member 100. The catalyst support 200 is housed so as to be brought into contact with the inner peripheral surface of the tubular member 100, but may be, for example, housed under a state in which the outer peripheral surface of the catalyst support 200 is covered with a holding mat (not shown).

The catalyst support 200 includes a honeycomb structure portion 220 and a pair of electrode portions 240 arranged on a side of the honeycomb structure portion 220 (typically so as to be opposed to each other across a central axis of the honeycomb structure portion). The honeycomb structure portion 220 includes an outer peripheral wall 222 and partition walls 224 which are arranged on an inner side of the outer peripheral wall 222 and which define a plurality of cells 226 extending from a first end surface 228*a* to a second end surface 228*b* to form the exhaust gas flow path. The outer peripheral wall 222 and the partition walls 224 are typically formed of conductive ceramics. The pair of electrode portions 240 and 240 are provided with terminals 260 and 260, respectively. One terminal is connected to a positive electrode of a power supply (e.g., a battery), and the other terminal is connected to a negative electrode of the power supply. On the periphery of the terminals 260 and 260, covers 270 and 270 each made of an insulating material are arranged so as to insulate the tubular main body 110 and the insulating layer 120 from the terminals 260.

The catalyst is typically supported by the partition walls 224. When the catalyst is supported by the partition walls 224, CO, $NO_x$, a hydrocarbon, and the like in the exhaust gas passing through the cells 226 can be formed into harmless substances by the catalytic reaction. The catalyst may preferably contain a noble metal (e.g., platinum, rhodium, palladium, ruthenium, indium, silver, or gold), aluminum, nickel, zirconium, titanium, cerium, cobalt, manganese, zinc, copper, tin, iron, niobium, magnesium, lanthanum, samarium, bismuth, barium, and a combination thereof.

The present invention is not limited to the embodiments described above, and various modifications may be made thereto. For example, the configuration shown in each of the embodiments may be replaced by substantially the same configuration, a configuration having the same action and effect, or a configuration which may achieve the same object.

The tubular member for an exhaust gas treatment device obtained by the manufacturing method according to at least one embodiment of the present invention can be suitably used for the treatment (purification) of an exhaust gas from an internal combustion engine.

According to at least one embodiment of the present invention, the insulating layer excellent in quality with suppressed thickness unevenness can be formed.

Many other modifications will be apparent to and be readily practiced by those skilled in the art without departing from the scope and spirit of the invention. It should therefore be understood that the scope of the appended claims is not intended to be limited by the details of the description but should rather be broadly construed.

What is claimed is:

1. A method of manufacturing a tubular member for an exhaust gas treatment device, the tubular member including a tubular main body made of a metal and an insulating layer formed on at least an inner peripheral surface of the tubular main body, the insulating layer containing glass, the method comprising steps of:

forming a coating film by spraying a coating liquid for insulating layer formation onto the inner peripheral surface of the tubular main body; and firing the coating film to obtain the insulating layer, wherein the tubular main body is subjected to heating at a heating temperature of 50° C. to 120° C.; and the spraying is performed while the tubular main body subjected to heating is rotated with a length direction thereof being a rotation axis.

2. The manufacturing method according to claim 1, wherein the coating liquid for insulating layer formation has a viscosity of 1 dPa·s or more.

3. The manufacturing method according to claim 1, wherein the forming a coating film is performed using a nozzle configured to jet the coating liquid for insulating layer formation, and wherein the spraying a coating liquid for insulating layer formation is performed by moving the nozzle in the tubular main body.

4. The manufacturing method according to claim 3, wherein the spraying is performed by repeating, a plurality of times, movement of the nozzle from a first end portion of the tubular main body to a second end portion thereof, and movement of the nozzle from the second end portion of the tubular main body to the first end portion thereof.

5. The manufacturing method according to claim 1, wherein the insulating layer has a thickness of 30 μm or more.

6. A method of manufacturing a tubular member for an exhaust gas treatment device, the tubular member including a tubular main body made of a metal and an insulating layer formed on at least an inner peripheral surface of the tubular main body, the insulating layer containing glass, the method comprising steps of:

forming a coating film by spraying a coating liquid for insulating layer formation onto the inner peripheral surface of the tubular main body; and firing the coating film to obtain the insulating layer, wherein the spraying is performed for the tubular main body subjected to heating at a heating temperature of 50° C. to 120° C.

7. The manufacturing method according to claim 6, wherein the heating of the tubular main body is performed at a timing selected from: during the spraying; before the spraying; after the spraying; or a combination thereof.

8. The manufacturing method according to claim 6, wherein the coating liquid for insulating layer formation has a viscosity of 1 dPa·s or more.

9. The manufacturing method according to claim 6, wherein the forming a coating film is performed using a nozzle configured to jet the coating liquid for insulating layer formation, and wherein the spraying a coating liquid for insulating layer formation is performed by moving the nozzle in the tubular main body.

10. The manufacturing method according to claim 9, wherein the spraying is performed by repeating, a plurality of times, movement of the nozzle from a first end portion of the tubular main body to a second end portion thereof, and movement of the nozzle from the second end portion of the tubular main body to the first end portion thereof.

11. The manufacturing method according to claim 6, wherein the insulating layer has a thickness of 30 μm or more.

* * * * *